US006684432B2

(12) United States Patent
Owens, Jr.

(10) Patent No.: US 6,684,432 B2
(45) Date of Patent: Feb. 3, 2004

(54) BED MATTRESS HAVING A SECURITY CONTAINER

(76) Inventor: Don E. Owens, Jr., 151 Orchard La., Statesville, NC (US) 28677

( * ) Notice: Subject to any disclaimer, the term of this patent is extended or adjusted under 35 U.S.C. 154(b) by 0 days.

(21) Appl. No.: 09/973,516

(22) Filed: Oct. 9, 2001

(65) Prior Publication Data

US 2003/0066135 A1 Apr. 10, 2003

(51) Int. Cl.[7] ..... A47C 31/00
(52) U.S. Cl. ..... 5/694; 5/931
(58) Field of Search ..... 5/694, 931, 58, 5/308, 503.1

(56) References Cited

U.S. PATENT DOCUMENTS

| | | | | | |
|---|---|---|---|---|---|
| 433,905 | A | * | 8/1890 | Muller | 5/694 |
| 795,155 | A | * | 7/1905 | Ness | 5/931 X |
| 2,895,145 | A | * | 7/1959 | Soifer | 5/931 X |
| 3,610,176 | A | * | 10/1971 | Fujiki | 109/31 |
| 3,683,827 | A | * | 8/1972 | Enright | 109/50 |
| 3,702,592 | A | * | 11/1972 | Gamble | 109/29 |
| 3,709,169 | A | * | 1/1973 | Gauger, Jr. et al. | 109/29 |
| 3,747,541 | A | * | 7/1973 | Reese | 109/50 |
| 3,779,179 | A | * | 12/1973 | Marois | 109/33 |
| 3,899,983 | A | * | 8/1975 | Hernandez | 109/54 |
| 3,901,167 | A | * | 8/1975 | Reese | 109/64 |
| 4,129,909 | A | | 12/1978 | Riehl | 5/317 R |
| 4,193,353 | A | * | 3/1980 | Hinton et al. | 109/50 |
| 4,457,240 | A | * | 7/1984 | Hungerford | 109/45 |
| 4,788,838 | A | | 12/1988 | Cislo | 70/63 |
| 4,807,315 | A | * | 2/1989 | Wachenheim | 5/931 X |
| 5,109,779 | A | * | 5/1992 | Maroist | 109/33 |
| D358,284 | S | | 5/1995 | Hill | D6/503 |
| 5,713,650 | A | | 2/1998 | King et al. | 312/265 A |
| 5,732,914 | A | | 3/1998 | Flinn | 248/201 |
| 5,896,605 | A | | 4/1999 | Branman | 5/716 |
| 5,931,104 | A | * | 8/1999 | Horn et al. | 109/59 R |
| 5,971,515 | A | * | 10/1999 | Baker et al. | 312/329 |
| 6,082,272 | A | | 7/2000 | Adrain | 109/51 |
| 6,292,960 | B1 | * | 9/2001 | Bowling | 5/308 |
| 2003/0066135 | A1 | * | 4/2003 | Owens, Jr. | 5/694 |
| 2003/0159214 | A1 | * | 8/2003 | Kurtz | 5/503.1 |

FOREIGN PATENT DOCUMENTS

| | | | | | |
|---|---|---|---|---|---|
| DE | 443419 | A | * | 9/1925 | 5/694 |

* cited by examiner

*Primary Examiner*—Robert G. Santos
(74) *Attorney, Agent, or Firm*—Christopher L. Bernard, PLLC

(57) ABSTRACT

A bed mattress system including a bed mattress apparatus, a security container having an interior portion, means for accessing the interior portion of the security container, and a moveable flap operable for covering the means for accessing the interior portion of the security container. The security container is operable for holding items disposed within the interior portion of the security container.

30 Claims, 6 Drawing Sheets

BED MATTRESS HAVING A SECURITY CONTAINER

FIELD OF THE INVENTION

The present invention relates generally to a bed mattress having a security container disposed within it. More specifically, the present invention relates to a bed mattress, such as an inner-spring mattress, a box spring, a foundation system, a soft-sided waterbed mattress, an air mattress, and a foam mattress, having a security container disposed within it operable for storing weapons, personal property, and valuables.

BACKGROUND OF THE INVENTION

Traditionally, individuals have stored weapons, personal property, and valuables, such as handguns, rifles, shotguns, contraceptives, books, magazines, photographs, videotapes, money, jewelry, wills, other legal documents, and the like in their bedroom. Specifically, individuals typically store such items in their nightstand, dresser, closet, or between the mattress and box spring of their bed, such that the items are secured from intruders, children, and others, and yet remain accessible. Intruders and children, however, are typically aware of such hiding places and such hiding places are typically not readily accessible.

Several U.S. Patents have attempted to deal with such limitations. U.S. Pat. No. 6,082,272 discloses a safe the size and shape of a box spring operable for supporting a bed mattress. U.S. Pat. No. 5,896,605 discloses a bed mattress having a zippered border attachment providing access to a hidden compartment on the interior of the mattress. U.S. Pat. No. 4,788,838 discloses a means to lock a handgun within a compartment while the compartment is readily lockable to a standard bed-frame without interfering with the position of the bed mattress or box spring. U.S. Pat. No. 5,732,914 discloses a gun holder for holding a rifle or shotgun on the side of a bed to allow a person lying or sitting on the bed quick and reliable access to the gun in the case of an emergency. U.S. Pat. No. 5,713,650 discloses wooden or steel modular furniture units with a secure container or safe. U.S. Pat. No. D358,284 discloses an ornamental design for a zippered bed storage compartment. U.S. Pat. No. 4,129,909 discloses an appliance adapted to engage the underside of a bed mattress and extend over the box spring, each extended end having pockets for the storage of bedroom articles.

What is needed is a bed mattress having a security container disposed within it. What is also needed is a bed mattress having a security container disposed within it which is comfortable to sleep on and sit on. What is further needed is a bed mattress having a security container which is relatively simple and inexpensive to manufacture.

BRIEF SUMMARY OF THE INVENTION

The present invention provides a bed mattress having a security container disposed within it which is comfortable to sleep on and sit on and which is relatively simple and inexpensive to manufacture.

In one embodiment, a bed mattress system includes a bed mattress apparatus, a security container having an interior portion, means for accessing the interior portion of the security container, and a moveable flap operable for covering the means for accessing the interior portion of the security container. The security container is disposed within the bed mattress apparatus and is operable for holding items disposed within the interior portion of the security container.

In another embodiment, a method for manufacturing a bed mattress system includes providing a bed mattress apparatus, disposing a security container within the bed mattress apparatus, providing means for accessing an interior portion of the security container, and covering the means for accessing the interior portion of the security container with a moveable flap. The security container is operable for holding items disposed within the interior portion of the security container.

In a further embodiment, a security container suitable for disposal within a bed mattress apparatus includes a hollow structure having an opening and an interior portion, the hollow structure operable for holding items disposed within the interior portion of the hollow structure.

DETAILED DESCRIPTION OF THE INVENTION

Figure 1:
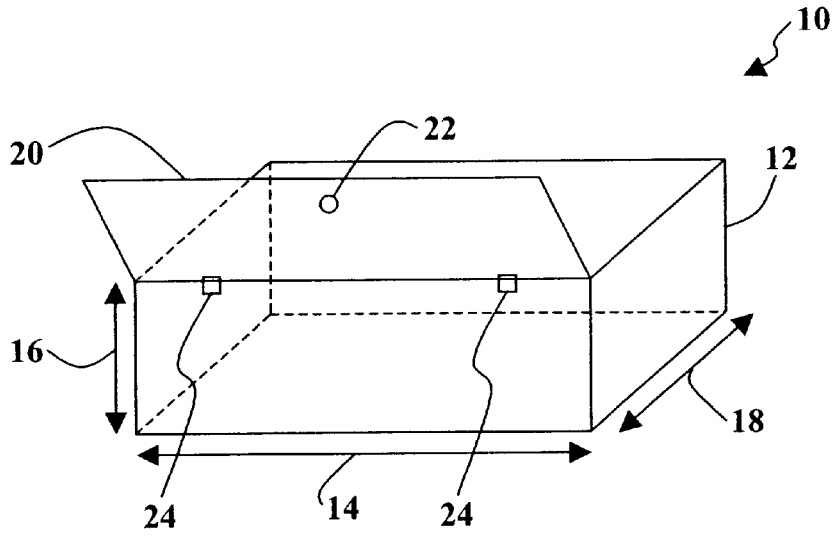
FIG. 1 is a perspective view of one embodiment of a standard security container suitable for disposal within an inner-spring mattress and a box spring.

Referring to FIG. 1, in one embodiment, a standard security container 10 suitable for disposal within an inner-spring mattress and a box spring comprises a rigid or semi-rigid box structure 12. In the embodiment shown, this box 12 has a width 14 of between about 5 inches and about 15 inches, a height 16 of between about 2.5 inches and about 5 inches, and a depth 18 of between about 5 inches and about 15 inches. The box 12 may also comprise a hollow structure having a circular shape, an elliptical shape, a triangular shape, a wedge shape, etc. The standard security container 10 may be made of, for example, wood, metal, plastic, fiberglass, and any other suitable rigid or semi-rigid material. Optionally, the rigid or semi-rigid material may be waterproof and/or fireproof to protect items disposed within the standard security container 10. The box 12 may also include a door 20 having a locking mechanism 22, such as a safety latch, a key lock, and a combination lock. The door 20 may be attached to the box 12 with hinges 24 or any other suitable attachment mechanism and may open upwards, downwards, or to either side. The door 20 may be operable for sealingly engaging and closing the box 12 and may be waterproof and/or fireproof. The standard security container 10 is operable for storing weapons, personal property, and valuables, such as handguns, contraceptives, books, magazines, photographs, videotapes, money, jewelry, a will, other legal documents, and the like.

Figure 2:
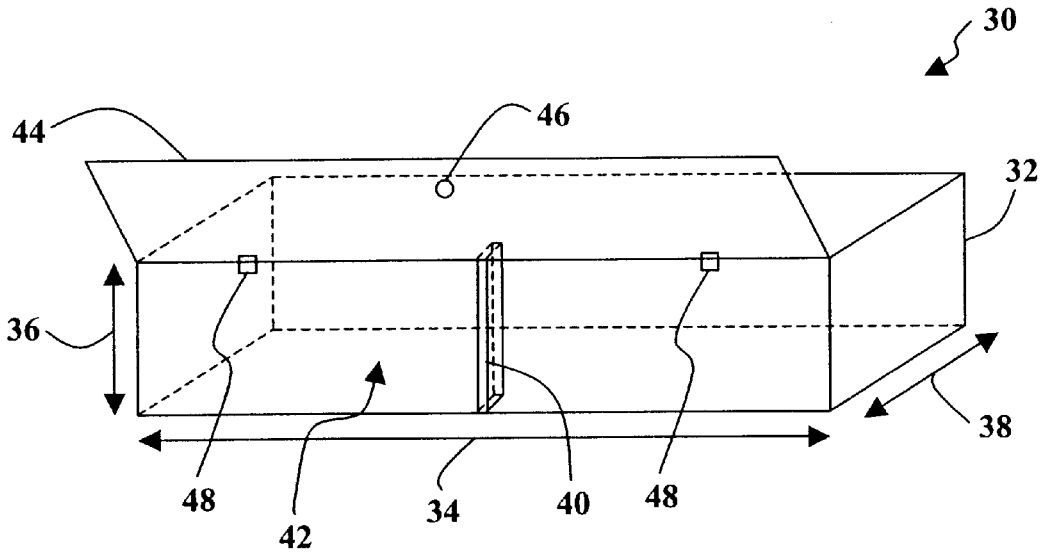
FIG. 2 is a perspective view of one embodiment of an elongated security container suitable for disposal within an inner-spring mattress and a box spring.

Referring to FIG. 2, in another embodiment, an elongated security container 30 suitable for disposal within an inner-spring mattress and a box spring comprises a rigid or semi-rigid box structure 32. In the embodiment shown, this box 32 has a width 34 of between about 25 inches and about 50 inches, a height 36 of between about 2.5 inches and about 5 inches, and a depth 38 of between about 5 inches and about 15 inches. The box 32 may also comprise a hollow structure having a circular shape, an elliptical shape, a triangular shape, a wedge shape, etc. The elongated security container 30 may be made of, for example, wood, metal, plastic, fiberglass, and any other suitable rigid or semi-rigid material. Optionally, the rigid or semi-rigid material may be waterproof and/or fireproof to protect items disposed within the elongated security container 30. The box 32 may include one or more supports 40 operable for stiffening the box 32. These supports 40 may be disposed within any suitable portion of the box 32. In the embodiment shown, one support 40 is disposed within the center portion of the opening 42 of the box 32. The box 32 may also include a door 44 having a locking mechanism 46, such as a safety latch, a key lock, and a combination lock. The door 44 may be attached to the box 32 with hinges 48 or any other suitable attachment mechanism and may open upwards, downwards, or to either side. The door 44 may be operable for sealingly engaging and closing the box 32 and may be waterproof and/or fireproof. The elongated security container 30 is operable for storing weapons, personal property, and valuables, such as handguns, rifles, shotguns, contraceptives, books, magazines, photographs, videotapes, money, jewelry, a will, other legal documents, and the like.

Figure 3:
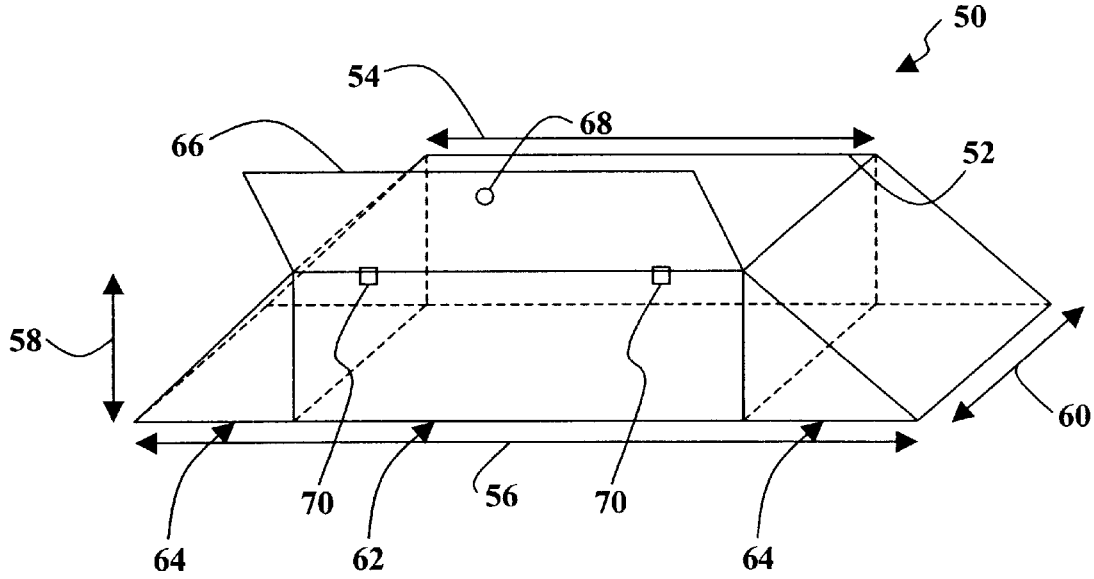
FIG. 3 is a perspective view of one embodiment of a security container suitable for disposal within a soft-sided waterbed mattress, an air mattress, and a foam mattress.

Referring to FIG. 3, in a further embodiment, a security container 50 suitable for disposal within a soft-sided waterbed mattress, an air mattress, and a foam mattress comprises a rigid or semi-rigid box structure 52. In the embodiment shown, this box 52 has an upper width 54 of between about 5 inches and about 15 inches, a lower width 56 of between about 15 inches and about 35 inches, a height 58 of between about 5 inches and about 10 inches, and a depth 60 of between about 2.5 inches and about 10 inches. The security container 50 includes a center box portion 62 and two downward-sloping side portions 64. The box 52 may also comprise a hollow structure having a square shape, a rectangular shape, a circular shape, an elliptical shape, a triangular shape, a wedge shape, etc. The security container 50 may be made of, for example, wood, metal, plastic, fiberglass, and any other suitable rigid or semi-rigid material. Optionally, the rigid or semi-rigid material may be waterproof and/or fireproof to protect items disposed within the security container 50. The box 52 may also include a door 66 having a locking mechanism 68, such as a safety latch, a key lock, and a combination lock. The door 66 may be attached to the box 52 with hinges 70 or any other suitable attachment mechanism and may open upwards, downwards, or to either side. The door 66 may be operable for sealingly engaging and closing the box 52 and may be waterproof and/or fireproof. The security container 50 is operable for storing weapons, personal property, and valuables, such as handguns, rifles, shotguns, contraceptives, books, magazines, photographs, videotapes, money, jewelry, a will, other legal documents, and the like.

Figure 4:
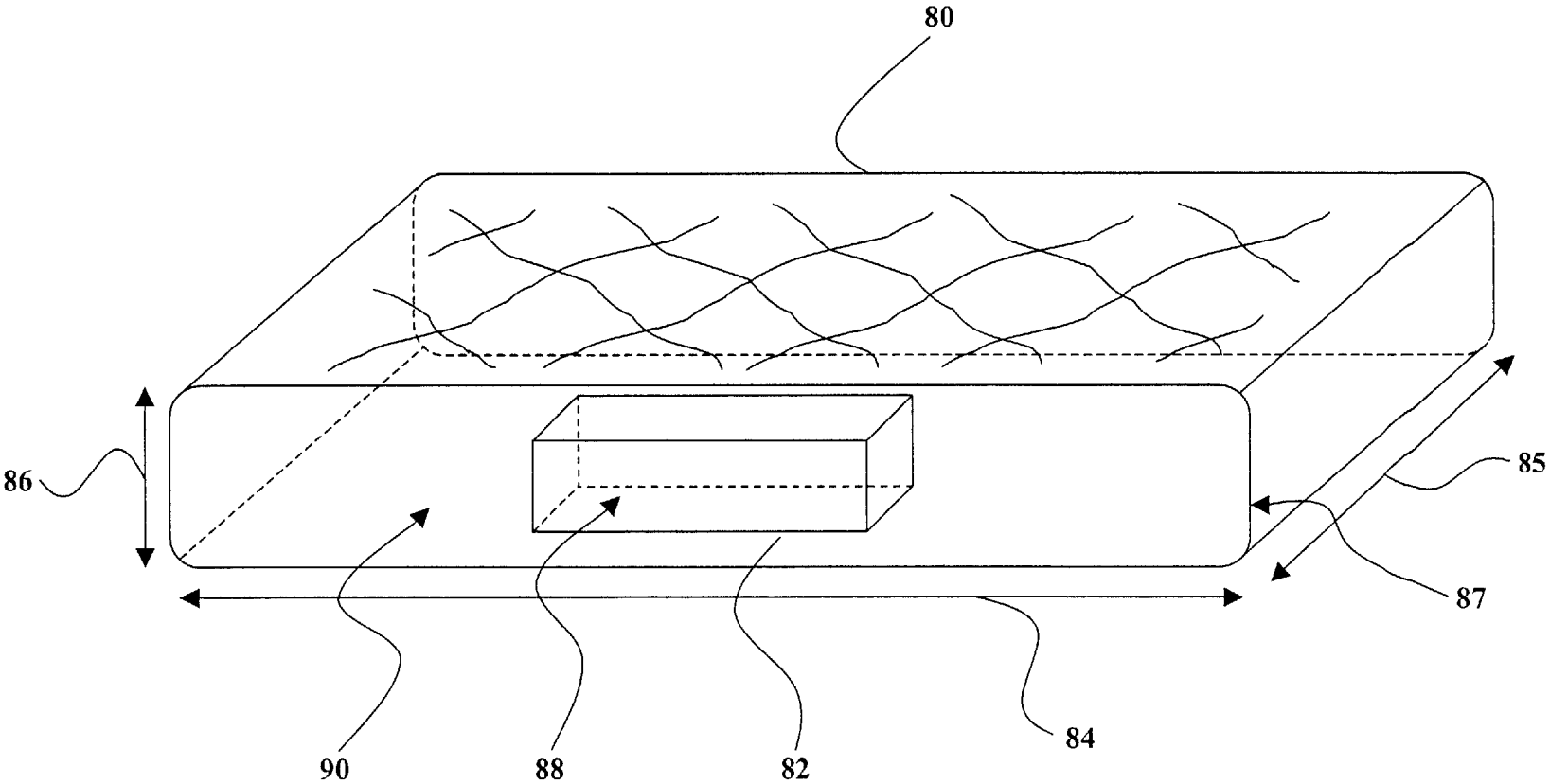
FIG. 4 is a perspective view of one embodiment of an inner-spring mattress or box spring having a security container disposed within it.

Referring to FIG. 4, in one embodiment, a bed mattress 80, such as an inner-spring mattress in the embodiment shown, having a security container 82, such as those described above, disposed within it may be manufactured such that the security container 82 is incorporated directly into the sleeping surface support system. The sleeping surface support system, as is well known to those skilled in the art, may include a plurality of springs, wooden supports, metal supports, fasteners, foam pads, covering materials, and the like. The security container 82 is preferably disposed within a cavity located within the bed mattress 80 at a predetermined location along the length 84 of the bed mattress 80 and the height 86 of the bed mattress 80. The security container 82 may also be disposed within a cavity located within the bed mattress 80 at a predetermined location along the width 58 of the bed mattress 80, spanning the length 84 or width 85 of the bed mattress 80, or at a corner 87 of the bed mattress 80. The security container 82 is also preferably disposed within the bed mattress 80 such that the opening 88 of the security container 82 is substantially adjacent to an edge 90 of the bed mattress 80. Optionally, the security container 82 may include a plurality of openings 88 and may be disposed within the bed mattress 80 such that the plurality of openings 88 of the security container 82 are substantially adjacent to a plurality of edges 90 of the bed mattress 80. The security container 82 is disposed within the bed mattress 80 such that an individual sleeping or sitting on top of the bed mattress 80 may readily access the opening 88 of the security container 82 and the contents thereof. The security container 82 is also disposed within the bed mattress 80 such that the security container 82 provides edge support for an individual sleeping or sitting on top of the bed mattress 80. Advantageously, the security container 82 of the present invention allows the outer six (6) inches of the sleep or seating surface, which is typically unusable, to be used. A plurality of security containers 82 may be disposed around the perimeter of the bed mattress 80, providing added storage capability and edge support.

Figure 5:
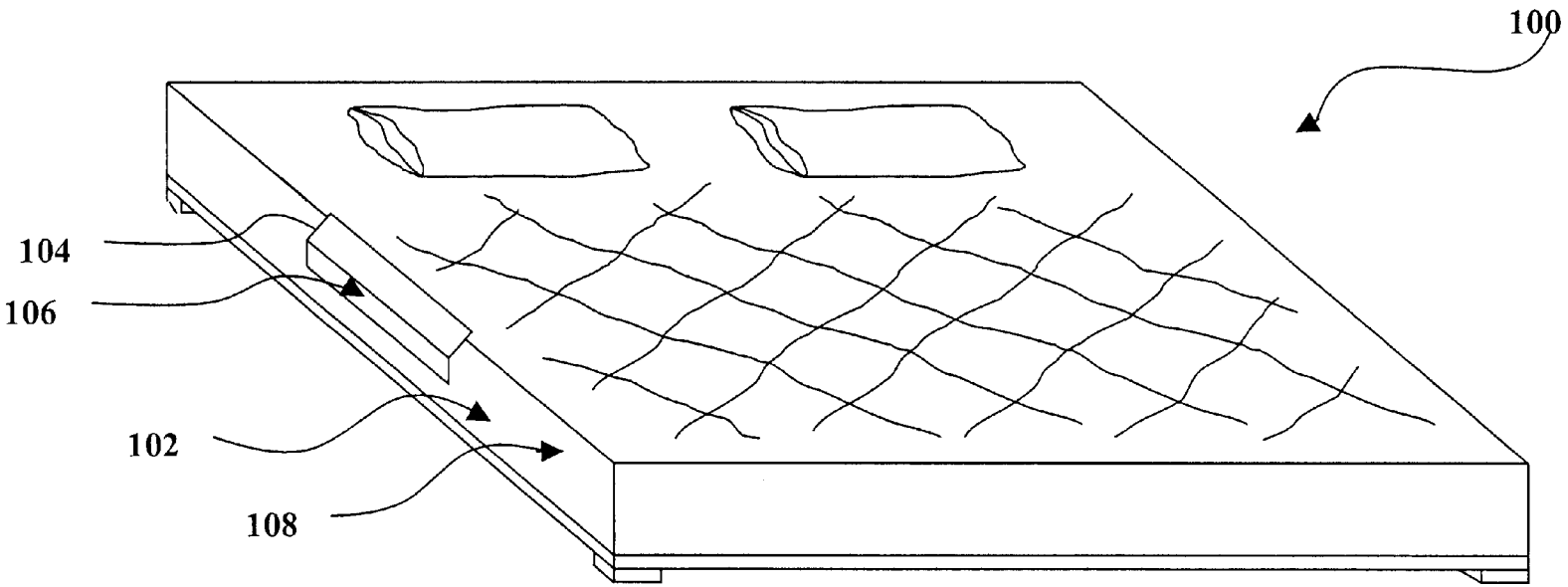
FIG. 5 is a perspective view of one embodiment of a bed mattress having a security container disposed within it, highlighting a door, a moveable flap, or a combination thereof.

Referring to FIG. 5, in one embodiment, a bed mattress 100 utilizing the security container 102 of the present invention includes a moveable flap 104 covering the opening 106 or door of the security container 102. The flap 104 preferably sits flush with the covering material of the side 108 of the bed mattress 100. To accomplish this, the opening 106 or door of the security container 102 may be recessed from the side 108 of the bed mattress 100. The flap 104 is also preferably made of a material which is identical in pattern to or closely matches the pattern of the covering material of the side 108 of the bed mattress 100, such that the flap 104 is hidden or concealed when closed. The flap 104 may be securely closed using Velcro, snaps, zippers, ties, or any other suitable securing mechanism. In the case of a security container 102 having a door, the flap 104 may be directly adjacent to and in contact with the door, or the flap 104 may be integrally formed with the door, and the locking mechanism may protrude through the flap 104. The flap 104 and door of the security container 102 are manufactured such that bed linen may be placed over the bed mattress 100, hiding or concealing the security container 102.

Figure 6:
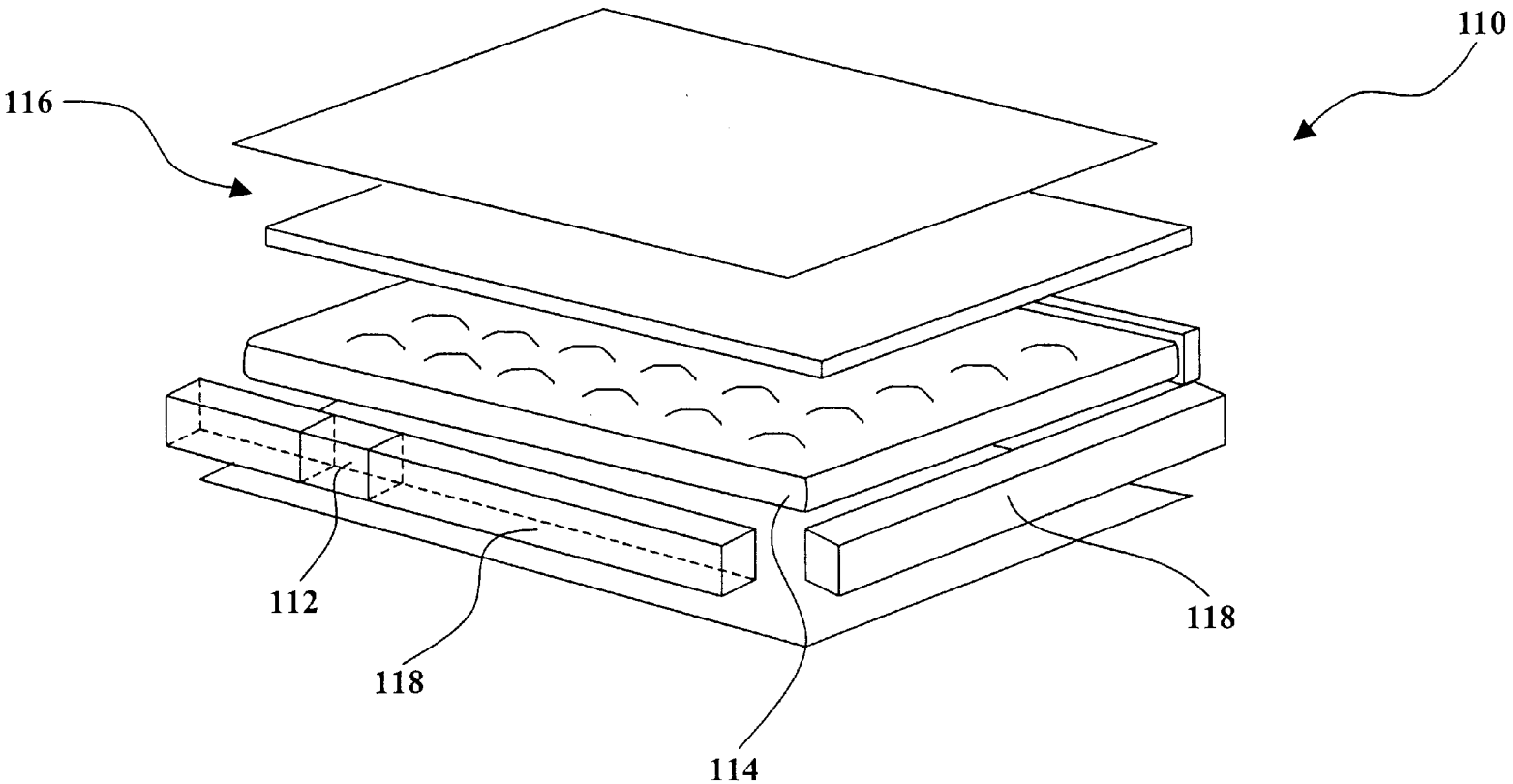
FIG. 6 is an exploded perspective view of one embodiment of a soft-sided waterbed mattress or an air mattress having a security container disposed within it.

Referring to FIG. 6, in one embodiment, a bed mattress 110, such as a soft-sided waterbed mattress or an air mattress, having a security container 112 disposed within it includes a vessel 114 suitable for holding water or air, a plurality of foam and fabric layers 116, and a plurality of supportive side rails 118. The security container 112 of the present invention is disposed within the side rails 118.

Figure 7:
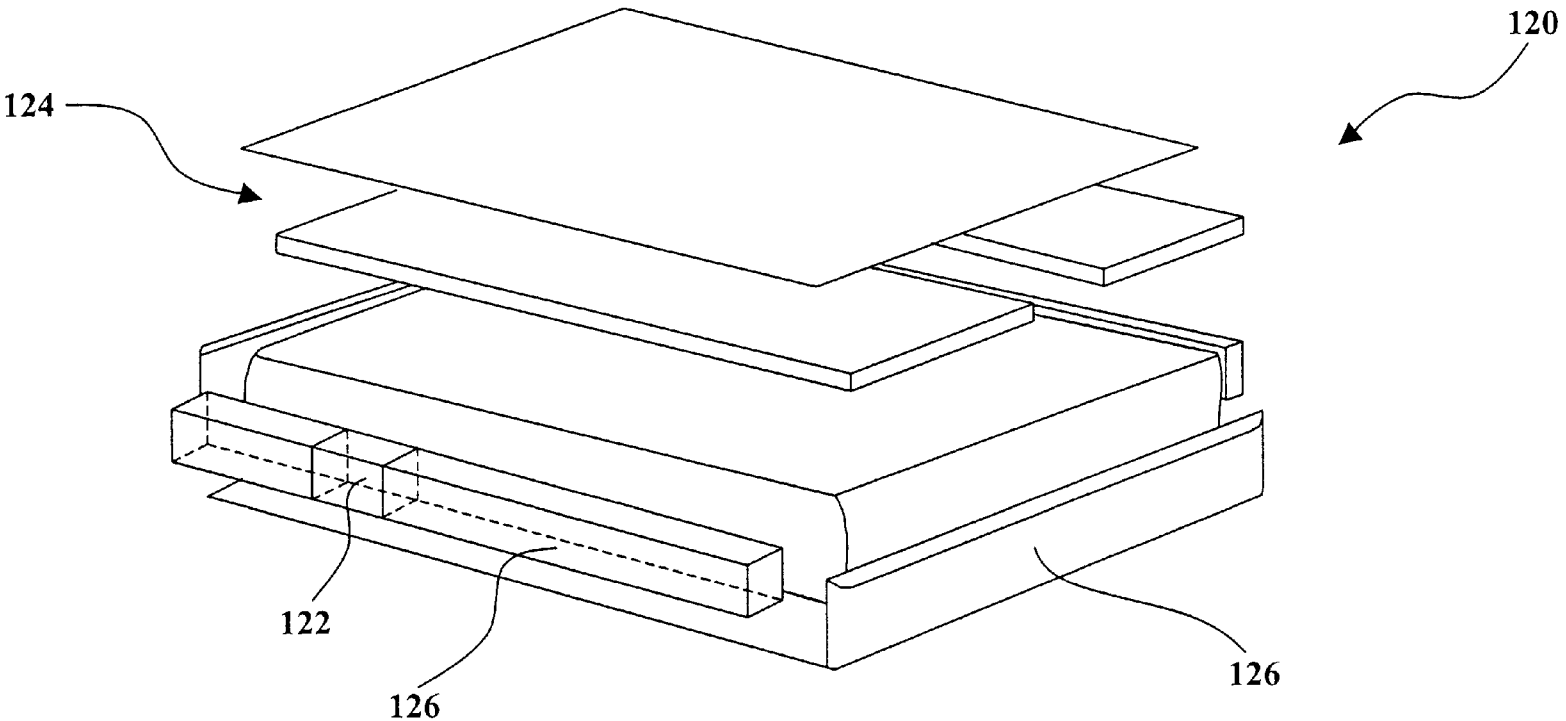
FIG. 7 is an exploded perspective view of one embodiment of a foam mattress having a security container disposed within it.

Referring to FIG. 7, in one embodiment, a bed mattress 120, such as a foam mattress, having a security container 122 disposed within it includes a plurality of foam and fabric layers 124 and, optionally, a plurality of supportive side rails 126. The security container 122 of the present invention is disposed within the side rails 126.

It is apparent that there has been provided, in accordance with the present invention, a bed mattress having a security container disposed within it. While the present invention has been shown and described in conjunction with examples and preferred embodiments thereof, variations in and modifications to the present invention may be effected by persons of ordinary skill in the art without departing from the spirit or scope of the invention. It is therefore to be understood that the principles described herein apply in a similar manner, where applicable, to all examples and preferred embodiments and the following claims are intended to cover all equivalent embodiments.

What is claimed is:

1. A bed mattress system, comprising:

a bed mattress apparatus, the bed mattress apparatus having an upper sleeping surface comprising an edge portion;

a security container disposed freely within the bed mattress apparatus, the security container having an interior portion, the security container operable for holding items disposed within the interior portion of the security container, wherein the security container is configured and positioned to rigidly support at least the edge portion of the upper sleeping surface of the bed mattress apparatus;

means for accessing the interior portion of the security container; and a moveable flap operable for covering the means for accessing the interior portion of the security container.

2. The bed mattress system of claim 1, wherein the bed mattress apparatus comprises a bed mattress apparatus selected from the group consisting of an inner-spring mattress, a soft-sided waterbed mattress an air mattress, and a foam mattress.

3. The bed mattress system of claim 1, wherein the security container comprises a box structure.

4. The bed mattress system of claim 3, wherein the box structure comprises a material selected from the group consisting of wood, metal, plastic, and fiberglass.

5. The bed mattress system of claim 3, wherein the box structure comprises a waterproof material.

6. The bed mattress system of claim 3, wherein the box structure comprises a fireproof material.

7. The bed mattress system of claim 1, wherein the bed mattress apparatus further comprises a covering material.

8. The bed mattress system of claim 7, wherein the moveable flap further comprises a material that substantially matches the covering material of the bed mattress apparatus.

9. The bed mattress system of claim 1, wherein the moveable flap further comprises a securing mechanism operable for securely closing the flap over the means for accessing the interior portion of the security container.

10. The bed mattress system of claim 9, wherein the securing mechanism comprises a securing mechanism selected from the group consisting of a hook-and-loop type fastener, a snap, a zipper, and a tie.

11. The bed mattress system of claim 1, wherein the security container further comprises a door operable for covering the means for accessing the interior portion of the security container, the door scalingly engaging and closing the security container.

12. The bed mattress system of claim 11, wherein the door comprises a waterproof material.

13. The bed mattress system of claim 11, wherein the door comprises a fireproof material.

14. The bed mattress system of claim 11, wherein the door further comprises a locking mechanism operable for securely closing the security container.

15. The bed mattress system of claim 14, wherein the locking mechanism comprises a locking mechanism selected from the group consisting of a safety latch, a key lock, and a combination lock.

16. A method for manufacturing a bed mattress system, the method comprising:

providing a bed mattress apparatus, the bed mattress apparatus having an upper sleeping surface comprising an edge portion;

disposing a security container freely within the bed mattress apparatus, the security container having an interior portion, the security container operable for holding items disposed within the interior portion of the security container, wherein the security container is configured and positioned to rigidly support at least the edge portion of the upper sleeping surface of the bed mattress apparatus;

providing means for accessing the interior portion of the security container; and covering the means for accessing the interior portion of the security container with a moveable flap.

17. The bed mattress manufacturing method of claim 16, wherein providing the bed mattress apparatus comprises providing a bed mattress apparatus selected from the group consisting of an inner-spring mattress, a soft-sided waterbed mattress, an air mattress, and a foam mattress.

18. The bed mattress manufacturing method of claim 16, wherein the security container comprises a box structure.

19. The bed mattress manufacturing method of claim 18, wherein the box structure comprises a material selected from the group consisting of wood, metal, plastic, and fiberglass.

20. The bed mattress manufacturing method of claim 18, wherein the box structure comprises a waterproof material.

21. The bed mattress manufacturing method of claim 18, wherein the box structure comprises a fireproof material.

22. The bed mattress manufacturing method of claim 16, wherein providing the bed mattress apparatus farther comprises providing a bed mattress apparatus having a covering material.

23. The bed mattress manufacturing method of claim 22, wherein covering the means for accessing the interior portion of the security container with the moveable flap further comprises covering the means for accessing the interior portion of the security container with a moveable flap of material that substantially matches the covering material of the bed mattress apparatus.

24. The bed mattress manufacturing method of claim 16, wherein covering the means for accessing the interior portion of the security container with the moveable flap further comprises covering the means for accessing the interior portion of the security container with a moveable flap having a securing mechanism operable for securely closing the flap over the means for accessing the interior portion of the security container.

25. The bed mattress manufacturing method of claim 24, wherein the securing mechanism comprises a securing mechanism selected from the group consisting of a hook-and-loop type fastener, a snap, a zipper, and a tie.

26. The bed mattress manufacturing method of claim 16, further comprising providing a door operable for covering the means for accessing the interior portion of the security container, the door scalingly engaging and closing the security container.

27. The bed mattress manufacturing method of claim 26, wherein the door comprises a waterproof material.

28. The bed mattress manufacturing method of claim 26, wherein the door comprises a fireproof material.

29. The bed mattress manufacturing method of claim 26, further comprising providing a door having a locking mechanism operable for securely closing the security container.

30. The bed mattress manufacturing method of claim 29, wherein the locking mechanism comprises a locking mechanism selected from the group consisting of a safety latch, a key lock, and a combination lock.

* * * * *